US005941415A

United States Patent [19]

Roethel

[11] Patent Number: 5,941,415

[45] Date of Patent: Aug. 24, 1999

[54] CUP DISPENSER

[75] Inventor: Henry G. Roethel, Ravenna, Ohio

[73] Assignee: The Meyer Company, Cleveland, Ohio

[21] Appl. No.: 08/854,335

[22] Filed: May 12, 1997

Related U.S. Application Data

[60] Provisional application No. 60/027,188, Oct. 2, 1996.

[51] Int. Cl.[6] ..... A47F 7/00

[52] U.S. Cl. ..... 221/310; 221/197; 312/43

[58] Field of Search ..... 312/43; 221/307, 221/310, 221, 197, 287, 283, 304, 44, 45, 46

[56] References Cited

U.S. PATENT DOCUMENTS

| | | | |
|---|---|---|---|
| Re. 17,664 | 5/1930 | Barbieri . | |
| 1,010,320 | 11/1911 | Ruehs . | |
| 1,388,977 | 8/1921 | Stejohen | 221/310 |
| 1,649,273 | 11/1927 | Wilson . | |
| 1,808,284 | 6/1931 | Bergmann . | |
| 1,940,067 | 12/1933 | Wessman . | |
| 2,073,328 | 3/1937 | Wasserlein | 221/310 |
| 2,315,827 | 4/1943 | Tansley . | |
| 2,487,736 | 11/1949 | Sims . | |
| 2,520,538 | 8/1950 | Gilbertsen . | |
| 2,780,388 | 2/1957 | Stephenson . | |
| 2,877,403 | 3/1959 | Bennett . | |
| 3,006,503 | 10/1961 | O'Neil | 221/307 |
| 3,163,323 | 12/1964 | Behrens et al. . | |
| 3,203,587 | 8/1965 | Mount et al. . | |
| 3,315,842 | 4/1967 | McGurk | 221/310 |
| 3,373,900 | 3/1968 | Staley . | |
| 3,435,988 | 4/1969 | Jonas et al. . | |
| 3,568,884 | 3/1971 | Petricek | 221/310 |
| 3,581,934 | 6/1971 | Sciascia | 221/310 |
| 3,595,435 | 7/1971 | Graham | 221/310 |
| 3,790,023 | 2/1974 | Filipowicz . | |
| 3,976,219 | 8/1976 | Pagnani | 221/310 |
| 4,126,248 | 11/1978 | House . | |
| 4,234,101 | 11/1980 | Pastore . | |
| 4,261,480 | 4/1981 | Fuss . | |
| 4,319,696 | 3/1982 | Stevens . | |
| 4,658,983 | 4/1987 | Suttles . | |
| 4,899,907 | 2/1990 | Benani | 221/310 |
| 5,040,761 | 8/1991 | Yu-Tseng . | |

*Primary Examiner*—H. Grant Skaggs

*Attorney, Agent, or Firm*—Fay, Sharpe, Beall, Fagan, Minnich & McKee

[57] ABSTRACT

The article dispensing apparatus includes an elongated barrel and a dispenser body received on the lower end of the elongated barrel for retaining and dispensing stacked articles. The dispenser body may be used to accommodate cups of a range of different sizes, shapes, and lip configurations due to a plurality of flexible fingers of the dispenser body. The flexible fingers are formed by pairs of spaced slots provided about a circumference of the dispenser body. The flexible fingers have radially inwardly sloping stop members which retain the cups and flex outward to dispense the cups. The elongated barrel is affixed to the dispenser body by one or more projections on the barrel which snap into corresponding recesses in the dispenser body.

15 Claims, 6 Drawing Sheets

CUP DISPENSER

This is a provision application Ser. No. 60/027,188 filed Oct. 2, 1996.

BACKGROUND OF THE INVENTION

This invention pertains to the art of dispensing and, more particularly, to cup dispensers for holding and dispensing a stack of nested cups.

Cups used in the food service industry and elsewhere come in various sizes and configurations such as lipped, cone shaped, or frusto-conical and in a variety of materials including paper and plastic. Most cup dispensers are designed to dispense only a single size and shape of cup. Therefore, if it is desired to change the size of the cups dispensed, it is also necessary to replace the dispenser.

Some existing dispensers have been made which can dispense cups of different sizes. Generally, these dispensers must be manually adjusted each time a new size of cup is used in the dispenser. Units of this type are difficult to adjust and more complex to manufacture due to the need for an adjustment mechanism.

The cup dispenser of the present invention addresses the problems of the prior art by accommodating a considerable range of sizes, shapes, and lip configurations without the need for adjustment of the dispenser to accommodate the different sizes, shapes, and types of cups.

SUMMARY OF THE INVENTION

In accordance with one aspect of the invention, and article dispensing apparatus includes an elongated barrel adapted to receive stacked articles and including an upper end, a lower end, and at least one projection at the lower end of the barrel, and a dispenser body received on the lower end of the elongated barrel. The dispenser body has a cylindrical shape including pairs of spaced slots provided about a circumference of the dispenser body. Each of the pairs of slots defines a flexible finger between the slots. The flexible fingers have radially inwardly sloping stop members. The projection of the elongated barrel is oriented to snap into a corresponding recess in the dispenser body to fix the barrel to the dispenser body.

In accordance with another aspect of the invention, an article dispensing apparatus includes a substantially cylindrical dispensing body having a longitudinal axis, a first end, and a second end, a plurality of fingers defined by pairs of longitudinal slots extending from the first end of the dispensing body and spaced circumferentially around the body, and a ramp extending from a central portion of each of the fingers and sloping radially inwardly toward the first end of the dispensing body. The ramps of each of the fingers together operate to retain stacked articles received in the substantially cylindrical dispensing body and the fingers flex radially outward to dispense the stacked articles from the body.

According to a further aspect of the invention, connecting member are disposed generally perpendicular to and connect between each of the ramps and the corresponding fingers.

According to an additional aspect of the invention, a recess is provided between each of the connecting members and the corresponding fingers for receiving an elastic member to increase the biasing force of the fingers on the stacked articles.

The improved cup dispenser provides an advantage over the known cup dispensers by accommodating a considerable range of sizes, shapes, and lip configurations as well as cups formed of different materials without the need for adjustment of the dispenser.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, the preferred embodiments of which will be described in detail in this specification and illustrated in the accompanying drawings which form a part hereof, and wherein.

DETAILED DESCRIPTION OF THE PREFERRED EMBODIMENTS

Figure 1:
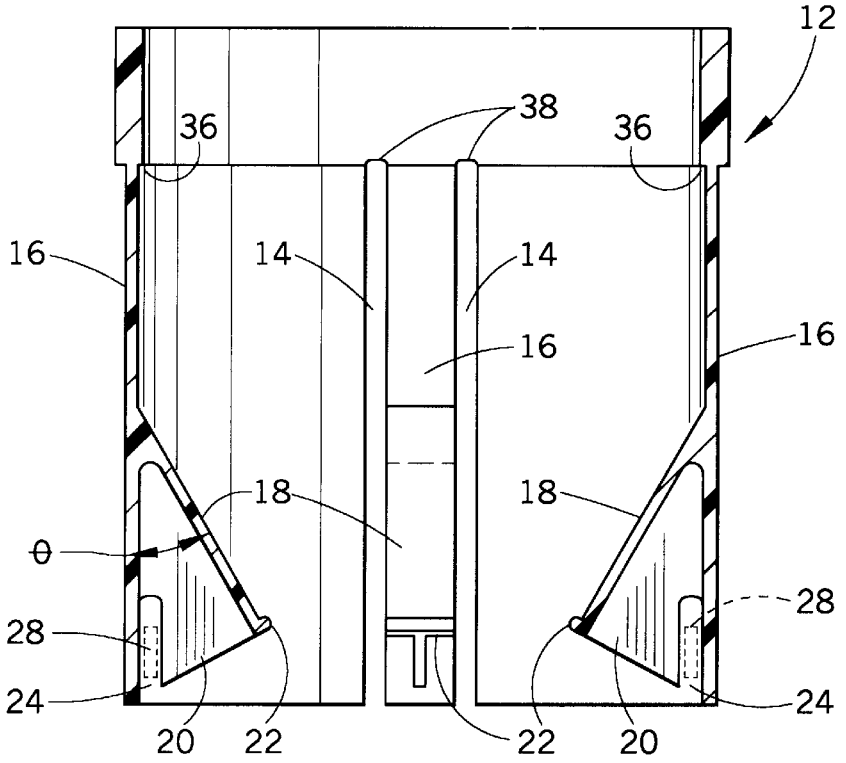
FIG. 1 is a cross-sectional side view of a first embodiment of the dispenser body.
Figure 2:
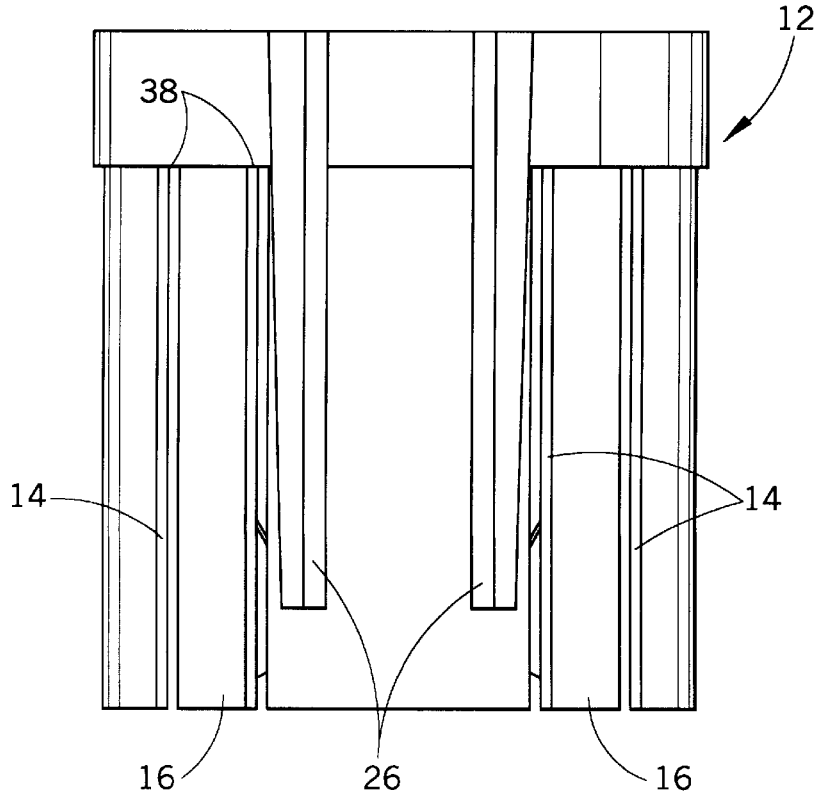
FIG. 2 is an elevational view of the dispenser body of FIG. 1.
Figure 3:
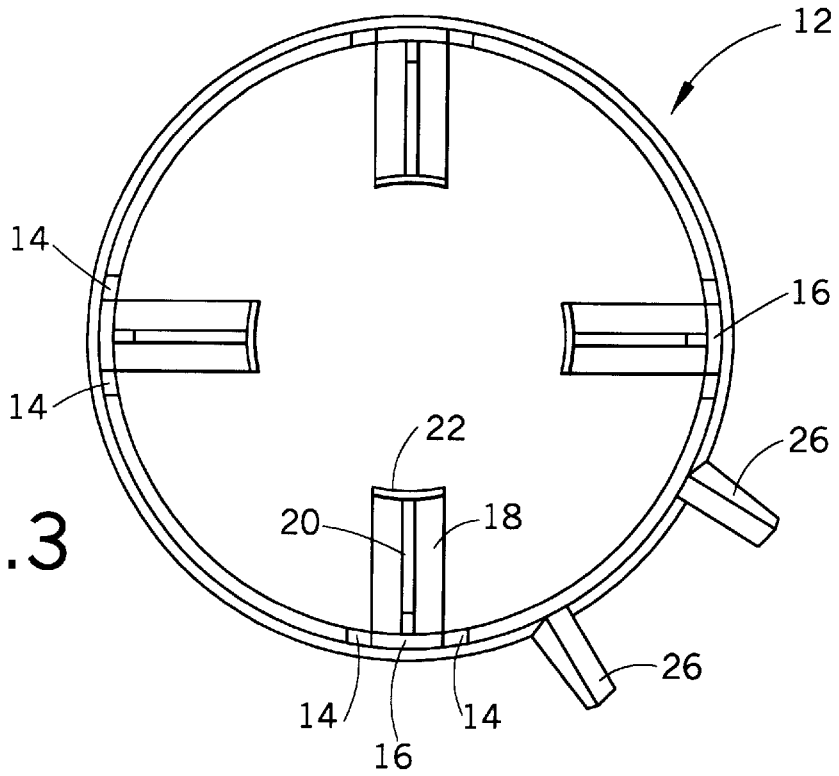
FIG. 3 is a bottom view of the dispenser body of FIG. 1.

Referring now to the drawings wherein the showings are for the purposes of illustrating the preferred embodiments of the invention only and not for purposes of limiting same, the FIGURES show a cup dispenser having an elongated barrel 10 within which stacked cups are adapted to be received, and a dispenser body 12 received on a lower end of the barrel and adapted to retain and dispense the cups from the barrel.

Figure 4:
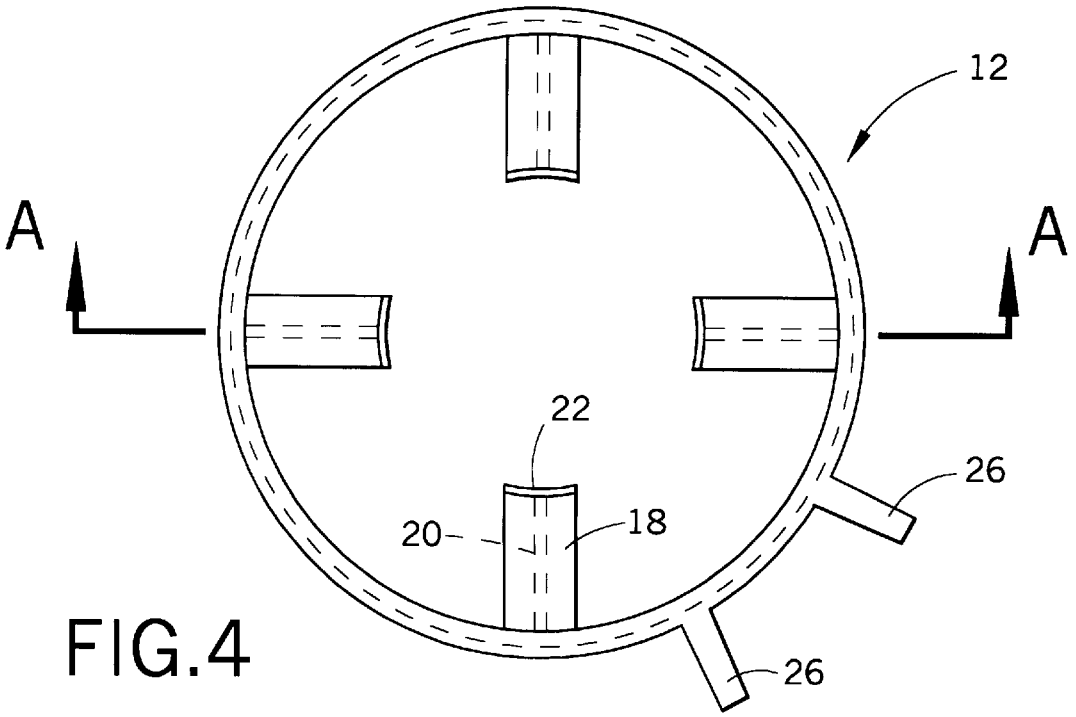
FIG. 4 is a top view of the dispenser body of FIG. 1.

As shown in the cross-sectional view of FIG. 1, the dispenser body 12 is a substantially cylindrical member having pairs of slots 14 extending longitudinally from a lower edge of the dispenser body. Each of the pairs of slots 14 define a finger 16 between the slots. Extending inwardly from each finger 16 is a ramp 18 which is formed integrally with the finger and provides a support surface for the cups or other articles to be dispensed. The ramp 18 is connected to the finger 16 at its upper end and is also connected to the finger by a connecting member 20. The connecting member or web 20 extends perpendicularly between the finger 16 and the ramp 18 and acts as a stiffening member. The cross-sectional view of FIG. 1 is taken along line A—A of FIG. 4 which passes through two of the connecting members 20. Each finger 16 and associated ramp 18 acts together with the other fingers and ramps to provide a stop against which the lowermost cup in a stack of nested cups is adapted to rest.

The use of the tapered or angled ramp members 18 permits the dispenser to accommodate cups of varying configurations and diameters. A small lip 22 is provided at the bottom of each ramp 18 to provide an additional cup arresting means when the dispenser is used with cups of very small diameter. The lips 22 on the ramps 18 will engage the lip of a small diameter cup. As seen from the top view of FIG. 4, the lips 22 are slightly arcuate in shape when viewed along the axis of the dispenser body. The ramps 18 extend at an angle ρ from the associated fingers. The angle ρ is preferably between 15° and 45°, more preferably between 25° and 35°.

The dispenser body 12 is formed of a material which has sufficient flexibility to allow the fingers 16 and consequently the ramps 18 to flex outwardly to allow cups to be dispensed. The fingers 16 generally will flex along an upper section between the ends or termini 38 of the slots and the area where the ramp 18 connects to the finger.

An upwardly extending recess or slot 24 is provided between each of the connecting members 20 and the associated finger 16. These recesses 24 allow a continuous elastic member 28, such as a rubber band, to be fitted into the recesses at each finger to provide the flexible fingers with a greater biasing force than that inherently imparted by the material from which the dispenser body is formed. Although many materials from which the dispenser body 12 can be fabricated are sufficiently resilient so as to not require an elastic band 28, the elastic band may also be used to increase the biasing force used to hold smaller cups. The biasing force exerted as the cups are pulled downward through the fingers 16 is sufficiently gentle to avoid crushing or otherwise damaging the cups.

A step 36 is formed around an interior surface of the dispenser body 12 for engagement with a corresponding member on the barrel 10. The dispenser body 12 also includes two external longitudinal ribs 26 which allow the dispenser body to be connected or mounted to a mounting surface by a mounting bracket. The ribs 26 extend generally radially from the cylindrical surface of the dispenser body 12.

Figures 5, 5A:
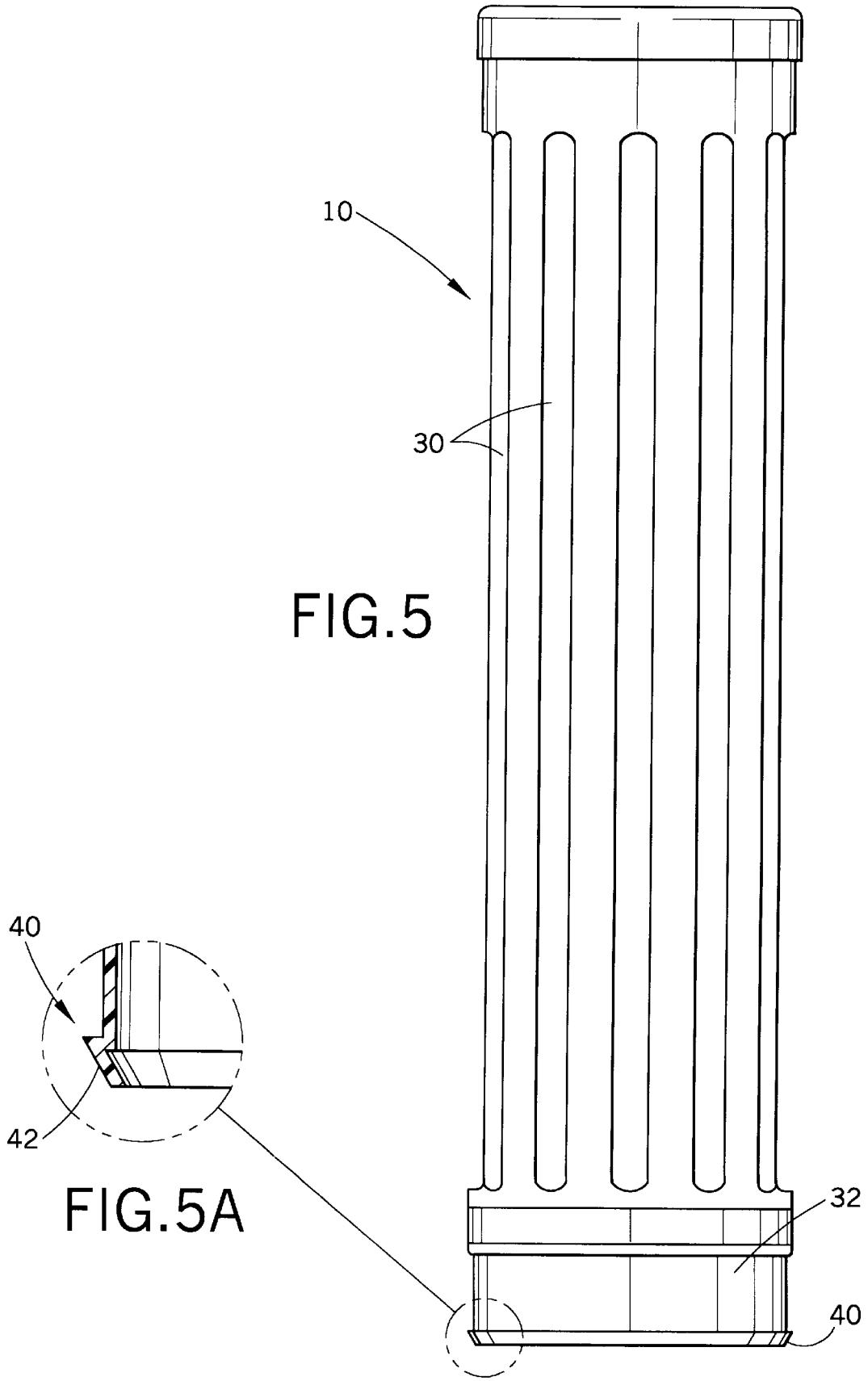
FIG. 5 is an elevational view of the barrel for use with the dispenser body of FIG. 1.
FIG. 5A is an enlarged cross-sectional view of a portion of FIG. 5.

The barrel 10 or magazine component of the dispenser is a cylindrical member formed of polypropylene or the like for receiving and accommodating stacked cups. A central portion of the barrel 10 is provided with flutes 30 which impart strength to the barrel. A lower end or cylindrical flange 32 of the barrel 10 has an external diameter which allows this flange to be received inside an upper end of the dispenser body 12 illustrated in FIGS. 1–4. The flange 32 of the barrel 10 includes a ramp 40 at a lower edge thereof which engages the step 36 on the interior of the dispenser body 12. An enlarged cross-sectional view of the ramp 40 is shown in FIG. 5A. The ramp 40 has an angled surface 42 which allows the lower end of the barrel 10 to be more easily inserted and snapped into the dispenser body 12.

Figure 6:
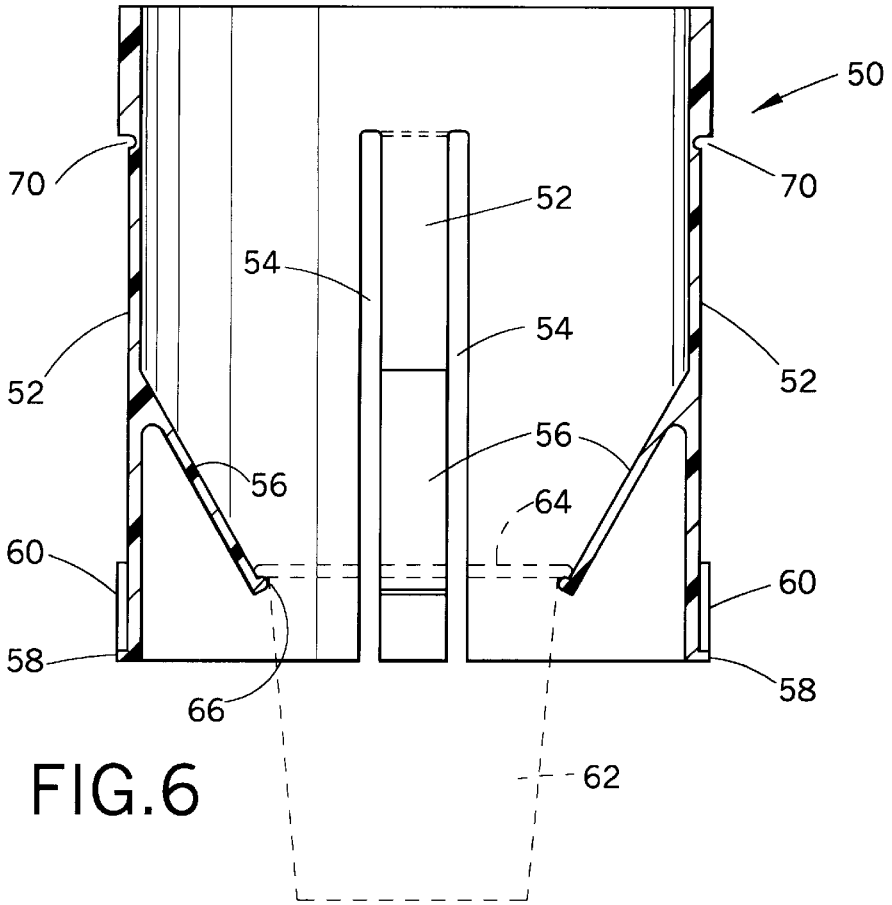
FIG. 6 is a cross-sectional side view of a second embodiment of the dispenser body.

FIG. 6 illustrates an alternative embodiment of the dispenser body 50 having fingers 52 defined by slots 54 and ramps 56 extending radially inwardly and downwardly from the fingers. This embodiment omits the connecting members for connecting the ramps to the fingers and includes a radial flange 58 at a lower end of the dispenser body for retaining an elastic band 60. As in the first embodiment, the elastic band 60 increases the biasing force applied by the fingers 52 to the cups.

As seen in FIG. 6, a small diameter cup 62 having a lip 64 is retained by the lips 66 on the ends of the ramps 56. The lips 66 on the ramps preferably have a semi-circular cross-section which allows the cups to be pulled past the lips without catching.

The embodiment of FIG. 6 also includes a rounded groove 70 extending circumferentially across the top of each of the fingers 52. This groove 70 causes the fingers 52 to flex at the top of the fingers and increases the overall flexibility of the fingers. The groove 70 may or may not be used depending on the flexibility of the material selected for the dispenser body 50.

Figure 7:
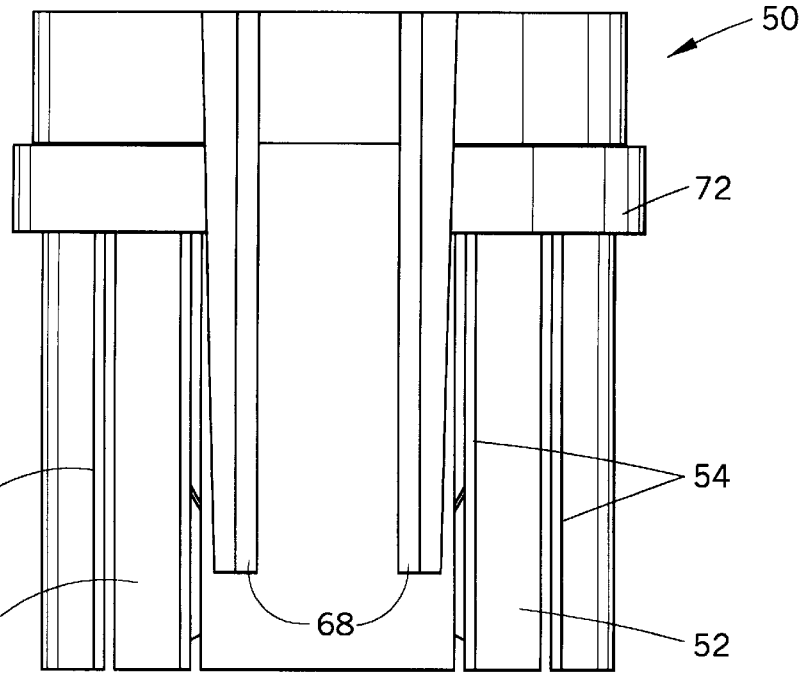
FIG. 7 is an elevational view of the dispenser body of FIG. 6 with a tension band.
Figure 8:
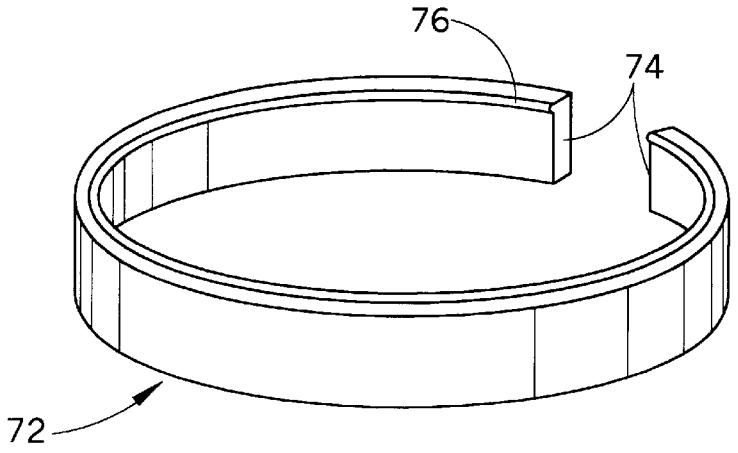
FIG. 8 is a perspective view of the tension band of FIG. 7.

The groove 70 also serves to retain a plastic tension band 72 which is an alternative to the elastic band 60. The plastic tension band 72, as shown in FIGS. 7 and 8, is a cylindrical plastic band having an opening 74 for accommodating the mounting ribs 68 and an annular rim 76 which is received in the groove 70. The plastic tension band 72 is removable and may be used when needed to provide the fingers 16 with a greater biasing force for holding smaller diameter cups.

Figure 9:
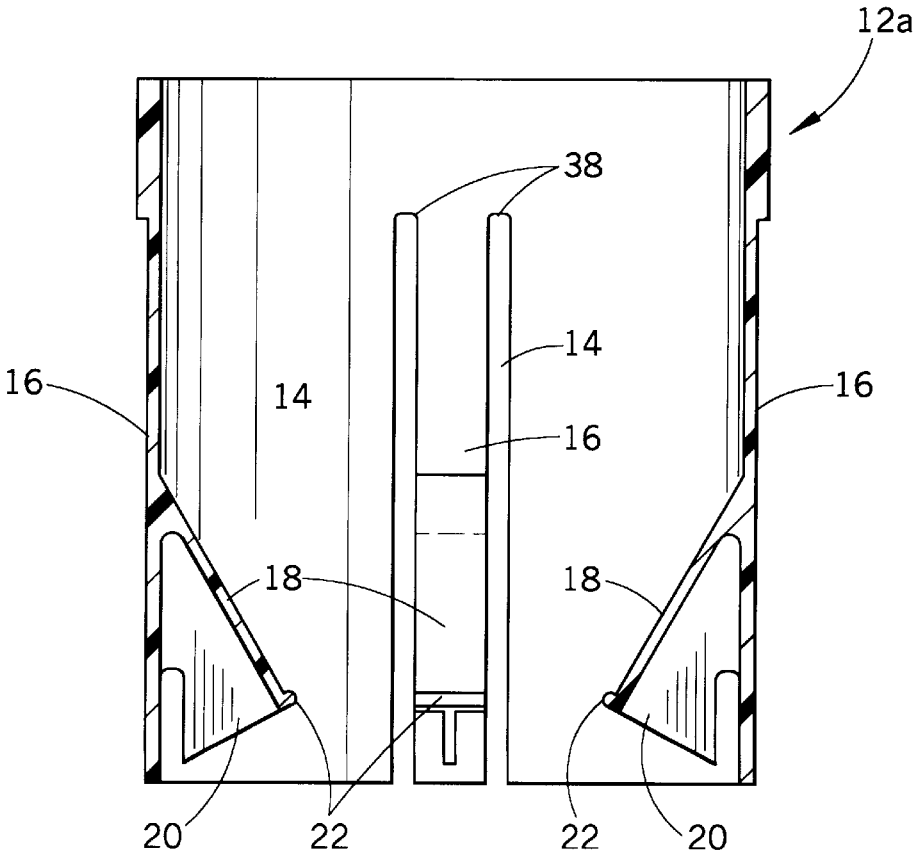
FIG. 9 is a cross-sectional side view of a third embodiment of the invention.
Figures 10, 11:
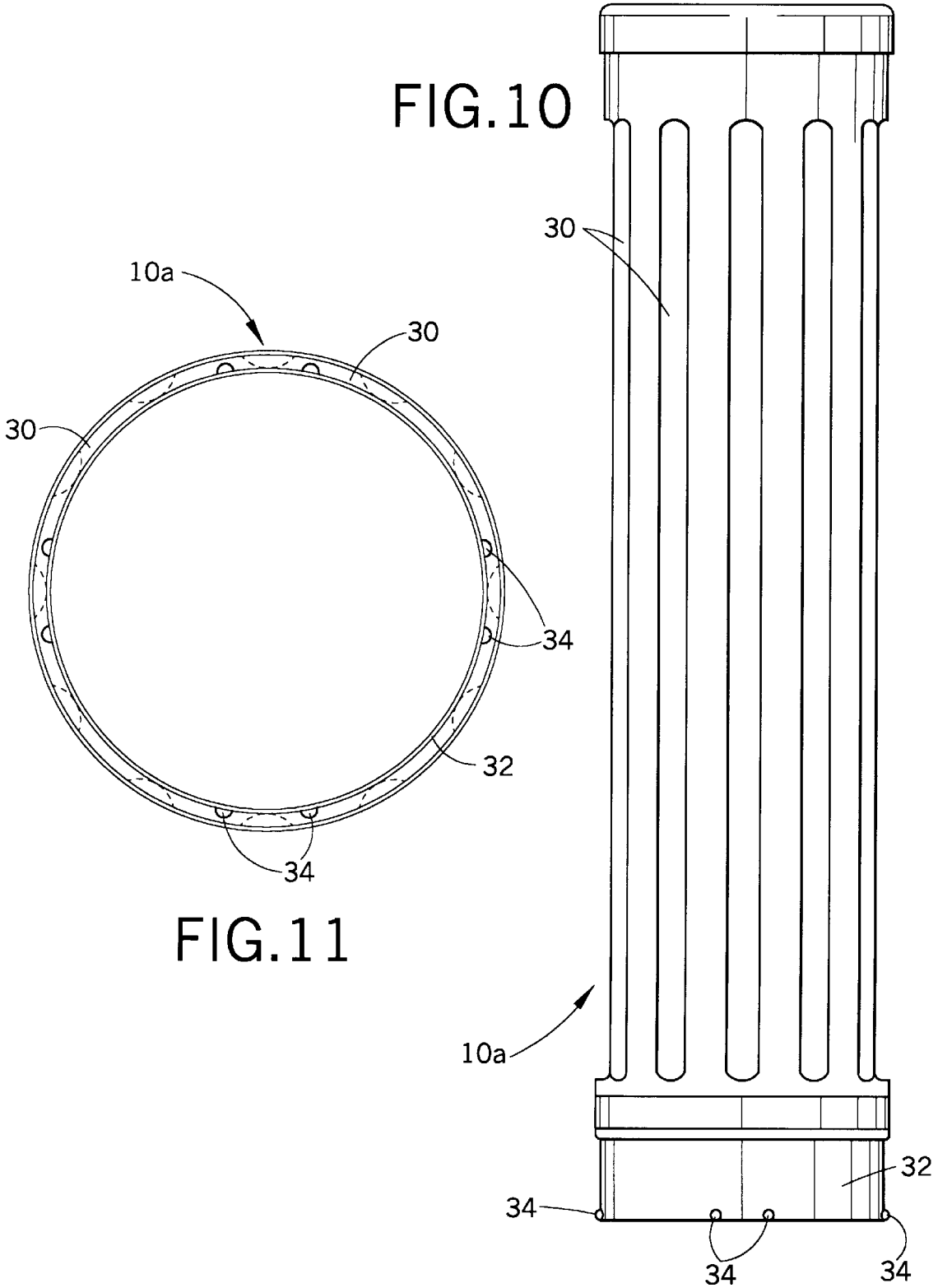
FIG. 10 is an elevational view of the barrel for use with the dispenser body of FIG. 9.
FIG. 11 is a bottom view of the barrel of FIG. 10.

An alternative embodiment for connecting a barrel 10*a* to a dispenser body 12*a* is illustrated in FIGS. 9–11. According to this embodiment, the flange 32 includes a plurality of small circumferentially spaced radially outwardly projecting nibs or detents 34. These detents 34 are arranged to snap into the upper termini 38 of the finger defining slots 14, in the dispenser body 12*a*, to fix the two components together. According to the alternative embodiment of the invention which is illustrated in FIGS. 9–11, eight slots 14 are provided in the dispenser body 12*a* to form four fingers 16. The barrel 10 is provided with eight detents 34 spaced to correspond with the eight slots 14 and sized to be accommodated in the upper termini 38 of the slots.

According to an alternative embodiment of the invention, the ramp 40 or the detents 34 may be omitted and the barrel 10 may be press fit into the dispenser body 12. Although the friction fit may be somewhat less secure than the use of engaging members such as a ramp or detents, this configuration is less expensive to manufacture. The barrel 10 may also be sized so that the flange 58 of the barrel fits around an outside surface of the dispenser body 12.

Although the present invention has been described as a dispenser for stacked cups, it should be understood that the dispenser can be used for other types of stacked articles such as ice cream cones and the like.

The invention has been described with reference to the preferred embodiments thereof. Obviously, modifications and alterations will occur to others upon a reading and understanding of this specification. The invention is intended to include all such modifications and alterations insofar as they come within the scope of the appended claims or the equivalents thereof.

Having thus described the invention, it is claimed:

1. An article dispensing apparatus comprising:

an elongated barrel adapted to receive stacked articles, said barrel including an upper end and a lower end;

a dispenser body having a first end and a second end and received on the lower end of the elongated barrel, the dispenser body having a cylindrical shape including pairs of spaced slots extending from the first end toward the second end and provided about a circumference of the dispenser body, each of the pairs of slots defining a flexible finger therebetween, said flexible fingers each having a radially inwardly sloping stop member projecting therefrom; and, a plurality of detents projecting from the barrel which snap, respectively, into ends of the slots when the barrel is received in the second end of the dispenser body.

2. The article dispensing apparatus of claim 1, wherein the barrel includes a fluted central section.

3. An article dispensing apparatus comprising:

an elongated barrel adapted to receive stacked articles, said barrel including an upper end and a lower end;

a dispenser body selectively connected to the lower end of the barrel and having a cylindrical shape including plural pairs of spaced slots provided about a circumference of the dispenser body, each of the pairs of slots defining a flexible finger therebetween;

a sloping stop member protecting radially inwardly from each of the flexible fingers; and, a connecting member disposed generally perpendicular to each of the stop members and connecting each of the stop members with an associated flexible finger.

4. An article dispensing apparatus comprising:

an elongated barrel adapted to receive stacked articles, said barrel including upper and lower ends;

a dispenser body received on the lower end of the barrel, said dispenser body defining a cylindrical shape and including pairs of circumferentially spaced slots extending from a lower end of the dispenser body toward and upper end, said pairs of slots arranged at circumferentially spaced locations and each pair defining a flexible finger therebetween;

a stop member projecting radially inwardly from each flexible finger and sloping downwardly toward said body lower end; and, a connecting member rigidly interconnecting at least a portion of each stop member to its respective flexible finger, each of said connecting members defining a recess therein radially between said stop member and said flexible finger, said recesses, together, adapted to receive and retain an elastic member to increase a radially inwardly directed biasing force of the fingers.

5. The article dispensing apparatus of claim 4, wherein the stop members include a lip at a radially innermost end thereof.

6. The article dispensing apparatus of claim 4, further comprising:

a ramp on an exterior surface of the barrel at the barrel lower end and a corresponding step on an interior surface of the dispenser body, said ramp and step adapted for engagement when said dispenser body is connected to the lower end of the barrel.

7. An article dispensing apparatus comprising:

a substantially cylindrical dispensing body having a longitudinal axis, a first end, and a second end;

a plurality of fingers defined by pairs of longitudinal slots extending from the first end of the dispensing body and spaced circumferentially around the body; and a ramp extending from a central portion of each of the fingers and sloping radially inwardly toward the first end of the dispensing body, the ramps of each of the fingers together retaining stacked articles received in the dispensing body and the fingers flexing radially outward to dispense the stacked articles from the dispensing body, said dispenser body defining a recess radially between each of said ramps and an associated finger, said recesses, together, adapted for receipt of an elastic member which exerts a radially inwardly directed biasing force on all of said fingers.

8. The article dispensing apparatus of claim 7, wherein the ramps extend at an angle of approximately 25° to approximately 35° with respect to the fingers.

9. The article dispensing apparatus of claim 7, wherein the ramps each include a lip at a radially innermost end thereof.

10. The article dispensing apparatus of claim 9, wherein the lips are arcuate in shape when view along an axial direction of the dispensing body.

11. An article dispensing apparatus comprising:

a substantially cylindrical dispensing body having a longitudinal axis, a first end, and a second end;

a plurality of fingers each defined by pairs of longitudinal slots extending from the first end of the dispensing body and spaced circumferentially around the body;

a ramp extending from a central portion of each of the fingers and sloping radially inwardly toward the first end of the dispensing body, the ramps of each of the fingers together retaining stacked articles received in the substantially cylindrical dispensing body, and the fingers flexing radially outward to dispense the stacked articles from the dispensing body; and, a connecting member disposed generally perpendicular to and interconnecting each ramp with an associated finger.

12. The article dispensing apparatus of claim 11, wherein each of said connecting members defines a recess for receiving an elastic member to increase a biasing force of the fingers on the stacked articles.

13. The article dispensing apparatus of claim 11, wherein a radial flange is provided on each of the fingers and an elastic member is disposed around the fingers to increase a biasing force of the fingers on the stacked articles.

14. The article dispensing apparatus of claim 11, wherein the each of the fingers includes a recess, and a continuous elastic member is received in the recesses to increase a biasing force of the fingers on the stacked articles.

15. The article dispensing apparatus of claim 11, further comprising a tension band removably mounted around the dispensing body to increase a biasing force of the fingers on the stacked articles.

* * * * *